US009869054B2

(12) United States Patent
Kuan

(10) Patent No.: US 9,869,054 B2
(45) Date of Patent: Jan. 16, 2018

(54) GARMENT TREATMENT DEVICE WITH FOLDABLE BOARD

(71) Applicant: KONINKLIJKE PHILIPS N.V., Eindhoven (NL)

(72) Inventor: Pooi Yeow Kuan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/120,594

(22) PCT Filed: Feb. 4, 2016

(86) PCT No.: PCT/EP2016/052416

§ 371 (c)(1),
(2) Date: Aug. 22, 2016

(87) PCT Pub. No.: WO2016/124705

PCT Pub. Date: Aug. 11, 2016

(65) Prior Publication Data

US 2017/0327996 A1 Nov. 16, 2017

(30) Foreign Application Priority Data

Feb. 6, 2015 (EP) ..... 15154050

(51) Int. Cl.
*D06F 81/08* (2006.01)
*D06F 81/04* (2006.01)

(52) U.S. Cl.
CPC ..... *D06F 81/08* (2013.01); *D06F 81/04* (2013.01)

(58) Field of Classification Search
CPC ..... D06F 1/00; D06F 1/02; D06F 1/04; D06F 1/08; D06F 1/10; A47B 1/03; A47B 3/00;
(Continued)

(56) References Cited

U.S. PATENT DOCUMENTS 2,647,333 A * 8/1953 Olshefski ..... D06F 81/02 108/169
3,641,946 A * 2/1972 Charnay ..... A47B 27/00 108/6

(Continued)

FOREIGN PATENT DOCUMENTS

CN 103334281 A 10/2013
CN 203462334 U 3/2014

(Continued)

OTHER PUBLICATIONS http://images.businessweek.com/ss/09/03/0320_international_home_housewares/29.htm Available in web on Jun. 5, 2014.

(Continued)

*Primary Examiner* — Ismael Izaguirre

(57) ABSTRACT

The present application relates to a garment treatment device comprising a base, a support structure extending upwardly from the base, and an ironing board connected to the support structure. The ironing board is pivotable relative to the support structure and positionable into a first operative position in which the ironing board is horizontal, and a second operative position in which the ironing board is vertical. The ironing board comprises a first section and a second section hingedly coupled together and pivotable relative to each other between an operative position in which they extend co-planar to each other and a storage position in which they are pivoted away from a co-planar orientation. The first and second ironing board sections (4*a*,4*b*) and the hinge mechanism (18) are configured such that the first and second ironing board sections (4*a*,4*b*) pivot away from each other from said operative position towards said storage position. The garment treatment device thereby advantageously enables garment it treatment in a variety of orientations, such as flat ironing or vertical steaming, with the ironing board providing garment support in all operative
(Continued)

positions. Also, the garment treatment device advantageously allows for a compact configuration in the storage position for efficiency of storage space.

14 Claims, 6 Drawing Sheets

(58) Field of Classification Search
CPC .... A47B 2200/0036; A47B 2200/0042; A47B 2200/0043
USPC ..... D6/397, 430; D32/66
See application file for complete search history.

(56) References Cited

U.S. PATENT DOCUMENTS 7,603,801 B2 10/2009 Jiang
7,856,743 B2 12/2010 Ma
8,205,363 B2 * 6/2012 Lin ..... D06F 75/12 38/77.6
8,881,434 B2 11/2014 Date
2002/0195911 A1 * 12/2002 Allen ..... G06F 1/1626 312/223.2
2010/0162596 A1 7/2010 Ma
2016/0047083 A1 * 2/2016 Yoo ..... D06F 75/16 38/1 A

FOREIGN PATENT DOCUMENTS

EP 0659926 A1 6/1995
FR 2695145 A1 3/1994
JP 58121999 A 7/1983
JP 3144290 U 8/2008
WO 2005040484 A1 5/2005
WO 2013038317 A1 3/2013
WO WO 2014076728 A2 * 5/2014
WO WO 2016078912 A1 * 5/2016

OTHER PUBLICATIONS http://astore.amazon.co.uk/__ie-UTF8-21/detail/B000J4E1N4 & http://www.youtube.com/watch?v=ZeuCDahXtqY Available in web on Jun. 5, 2014.

* cited by examiner

GARMENT TREATMENT DEVICE WITH FOLDABLE BOARD

This application is the U.S. National Phase application under 35 U.S.C. §371 of International Application No. PCT/EP2016/052416, filed on Feb. 4, 2016, which claims the benefit of International Application No. 15154050.7 filed on Feb. 6, 2015. These applications are hereby incorporated by reference herein.

FIELD OF THE INVENTION

The present invention relates to the field of garment treatment devices and, in particular, to garment treatment devices including a foldable ironing board.

BACKGROUND OF THE INVENTION

Various garment treatment devices are known. One such device is a stand steamer which normally consists of a garment hanger on one or more support poles, and a base unit that houses a steam generator and water tank, with a steamer head connected to the steam generator by a steam hose. Water from the water tank is converted into steam in the steam generator. This steam is then transferred from the steam generator to the steamer head via the steam hose for use in de-wrinkling a garment.

Stand steamers allow clothes to be ironed while vertically hanged. However, an absence of firm treatment support surface means that they are generally not capable of providing neat and creased effect in clothing treatment, such as required for more formal business attire. Also, they are less effective on thicker fabrics and tricky areas of the garments, such as cuffs, collars and under-arm regions. Stand steamers also require a user to manually stretch a garment during treatment which can risk accidental scorching of a user's hand by the hot steam.

Some stand steamers come with a steamer head configured to enable horizontal ironing. However, this necessitates a separate ironing board which can be inconvenient and takes up additional space during use and in storage.

US2010/162596A1 discloses an ironing board having two sections. One section is pivotable onto the other section in a storage position.

SUMMARY OF THE INVENTION

It is an object of the invention to provide a garment treatment device which substantially alleviates or overcomes one or more of the problems mentioned above.

The invention is defined by the independent claims. The dependent claims define advantageous embodiments.

According to the present invention, there is provided a garment treatment device comprising a base, a support structure extending upwardly from the base, and an ironing board connected to the support structure, the ironing board being pivotable relative to the support structure and positionable into a first operative position in which the ironing board is horizontal, and a second operative position in which the ironing board is vertical, wherein the ironing board comprises a first section and a second section hingedly coupled together and pivotable relative to each other between an operative position in which they extend co-planar to each other and a storage position in which they are pivoted away from a co-planar orientation, wherein the first and second ironing board sections and the hinge mechanism are configured such that the first and second ironing board sections pivot away from each other from said operative position towards said storage position. The garment treatment device thereby advantageously enables garment treatment in a variety of orientations, such as flat ironing or vertical steaming, with the ironing board providing garment support in all operative positions. Also, the garment treatment device advantageously allows for a compact configuration in the storage position for efficiency of storage space.

The ironing board is preferably positionable into a third operative position which extends at an inclined angle between the horizontal and vertical positions. The ironing board is preferably positionable into a plurality of intermediate operative positions between the horizontal and vertical operative positions. This advantageously provides greater flexibility of operation for a user, so an optimum garment treatment position can be achieved.

The first and second ironing board sections are preferably pivotable relative to each other through substantially 180 degrees between the operative and storage positions. The first and second ironing board sections are preferably spaced from each other and substantially parallel to each other when in the storage position. The first and second ironing board sections are preferably disposed on either side of the support structure to each other when in the storage position. The ironing board is preferably divided into the first section and second section proximate a mid-point along the length of the ironing board. These features each advantageously further allow a compact configuration in the storage position for efficiency of storage space.

The support structure preferably comprises a telescopic mechanism to vary the distance between the ironing board and the base. This enables the height of the ironing board from the ground to be adjusted to suit users of different heights. Also, this further allows the garment treatment device to be collapsed into a compact configuration in the storage position for efficiency of storage space.

The telescopic mechanism preferably comprises a pair of parallel spaced telescopic support posts extending from the base and to which the ironing board is pivotably connected. This may advantagesouly provide a stable and strong support for the ironing board.

An end of the ironing board that is uppermost in the vertical operative position preferably comprises a region of ironing surface of increased width relative to the rest of the ironing board. This may advantageously provide more garment treatment area for larger garments. This may also advantageously allow a garment to be hung more easily from the ironing board when in the second, vertical, operative position.

The ironing board preferably comprises a first opposite side, a second opposite side, and a three dimensional structure spacing fabric extending over at least a portion of both the first and a second sides of the ironing board. This may advantageously allow treatment of a garment on the ironing board from both sides of the ironing board. The three dimensional fabric may also advantageously space garments being treated from the ironing board surface, such that steam may pass though the fabric of the garment and be deflected back to the rear side of the garment fabric. This may more fully utilise the garment treatment effect of the steam to benefit garment treatment effectiveness, for example wrinkle removal.

The garment treatment device preferably further comprises a steam generator disposed in the base, a hand-held steamer head, and a steam hose fluidly connecting a steam outlet of the steam generator with the hand-held steamer head. The garment treatment device is thereby advantageously of a more compact configuration with associated good usability.

The hand-held steamer head preferably includes a heated sole plate. This may advantageously improve effectiveness of garment treatment operations using the hand-held steamer head.

The ironing board preferably comprises a skeleton frame.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
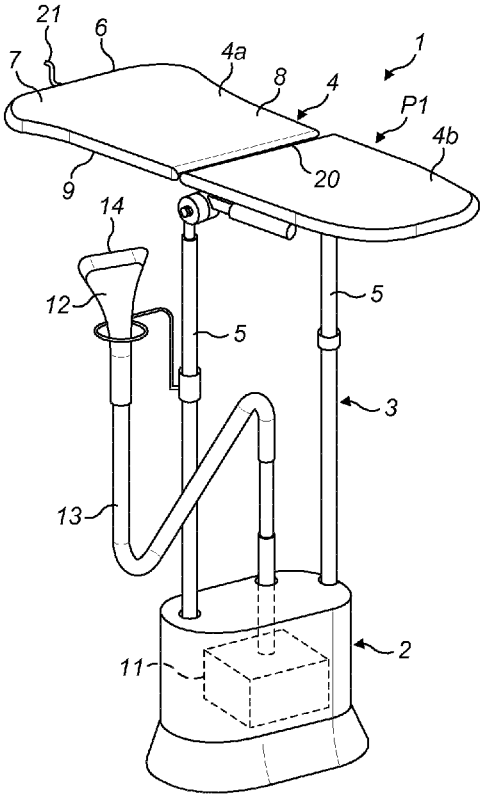
FIG. 1 shows a perspective view of a garment treatment device of an embodiment of the invention in a horizontal operative position.

FIG. 1 shows a perspective view of a garment treatment device 1 according to an embodiment of the invention.

The garment treatment device 1 comprises a base 2. The base 2 is intended to contact with the ground during operation by a user. The garment treatment device 1 also comprises a support structure 3 extending upwardly from the base 2. The garment treatment device 1 also comprises an ironing board 4 which is pivotable relative to the support structure 3. The ironing board 4 is pivotable relative to the support structure (3) and is positionable into a first operative position P1 (shown in FIG. 1), in which the ironing board is horizontal, and a second operative position P2 (shown in FIGS. 5 and 6) in which the ironing board 4 is vertical.

The ironing board 4 comprises a first section 4*a* and a second section 4*b*. The first and second sections 4*a*, 4*b* are hingedly coupled together and pivotable relative to each other between an operative position in which they extend co-planar to each other and a storage position in which they are pivoted away from a co-planar orientation. In the first (horizontal) operative position P1, the first ironing board section 4*a* and the second ironing board section 4*b* are co-planar. Similarly, in the second (vertical) operative position P2, the first ironing board section and the second ironing board section 4*b* are co-planar.

The first and second sections 4*a*, 4*b* are connected by a hinge mechanism 18 so as to be pivotable relative to each other between an operative position in which the first and second sections 4*a*, 4*b* are co-planar with each other (as shown in FIGS. 1, and 5 to 7) and a storage position P4 in which the first and second sections 4*a*, 4*b* are pivoted away from a co-planar orientation. The hinge mechanism 18 preferably includes a fixing mechanism which fixes and locks the first and second ironing board sections 4*a*, 4*b* in the operative position in which they extend coplanar with each other. The fixing mechanism may include a release lever, button or other actuator which unlocks the fixing mechanism to enable the ironing board 4 to be folded in half with the first and second ironing board sections 4*a*, 4*b* being pivoted relative to each other into the storage position P4.

Figure 7:
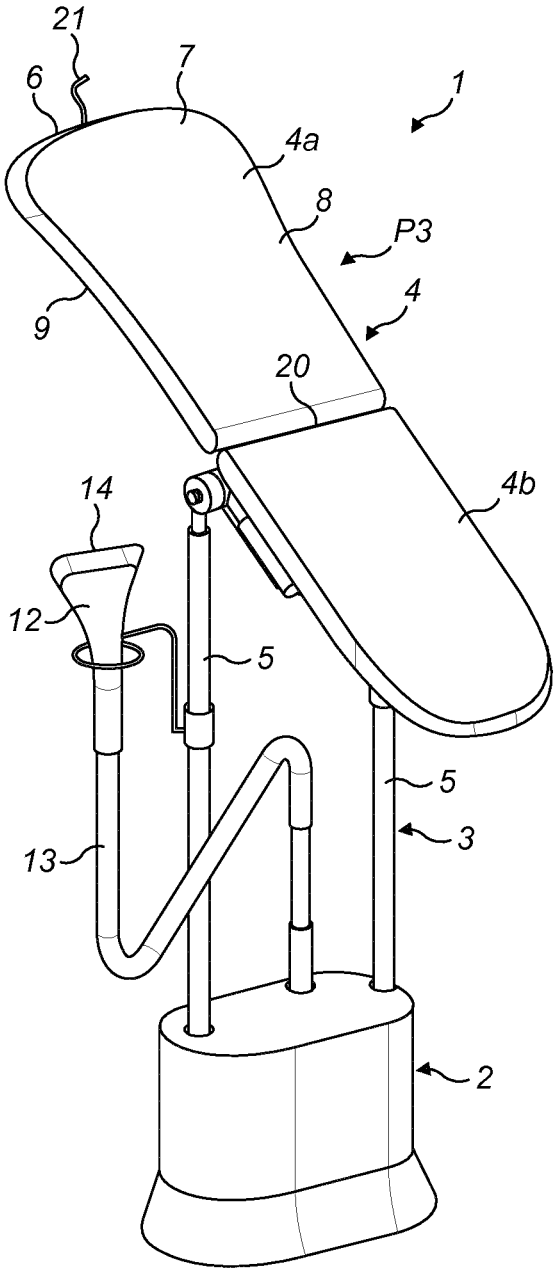
FIG. 7 shows a perspective view of the device of FIG. 1 in an inclined operative position.

The ironing board 4 is preferably positionable into a third operative position P3 between the first (horizontal) operative position P1 and the second (vertical) operative position P2, as shown in FIG. 7. In the third operative position P3, the ironing board 4 is inclined at an angle between the first (horizontal) and second (vertical) operative positions P1, P2. Also, in the third (inclined) operative position P3, the first and second ironing board sections 4*a*, 4*b* are co-planar.

The ironing board 4 is preferably positionable into a plurality of intermediate inclined operative positions P3 between the first operative position P1 (horizontal) and the second operative position P2 (vertical). The garment treatment device 1 is preferably configured such that the ironing board 4 can be locked in any of the selected operative positions.

Figure 8:
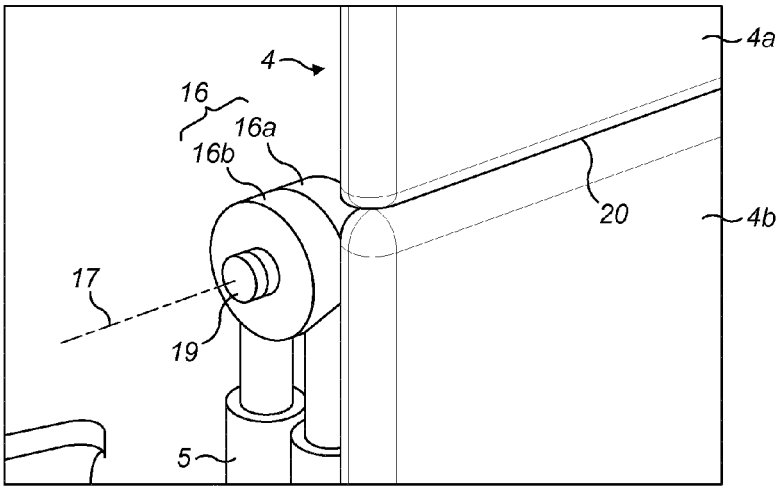
FIG. 8 shows an enlarged view of a portion of the device of FIG. 1.

The support structure 3 preferably comprises a pair of parallel telescopic support posts 5 which extend upwardly from the base 2 and are connected to a pivot mechanism 16 at their end opposite to the base 2. The pivot mechanism 16 is shown in more detail in FIG. 8 and preferably comprises, on each side of the garment treatment device 1, a first pivot portion 16*a* connected to the second ironing board section 4*b* and a second pivot portion 16*b* connected to the top of the support post 5. The first and second pivot portions 16*a*, 16*b* are pivotably connected about a pivot axis 17 to enable the second ironing board section 4*b* to pivot relative to the support posts 5. The ironing board 4 is thereby preferably able to be positioned into a chosen operative position, either horizontal, vertical, or at an angle between the horizontal and vertical. The pivot mechanism 16 preferably includes a locking mechanism to lock the ironing board 4 in the chosen operative position. The locking mechanism may comprise a clamp (not shown), or may comprise inter-engaging ratchet teeth (not shown) formed on the first and second pivot portions 16*a*, 16*b*. The locking mechanism may be biased into a locked position and may include a button 19 (see FIG. 8) operable to disengage the locking mechanism to allow pivoting of the ironing board 4 relative to the base 2. The button 19 may be released to allow the locking mechanism to re-engage to lock the ironing board 4 in the chosen operative position.

Figure 2:
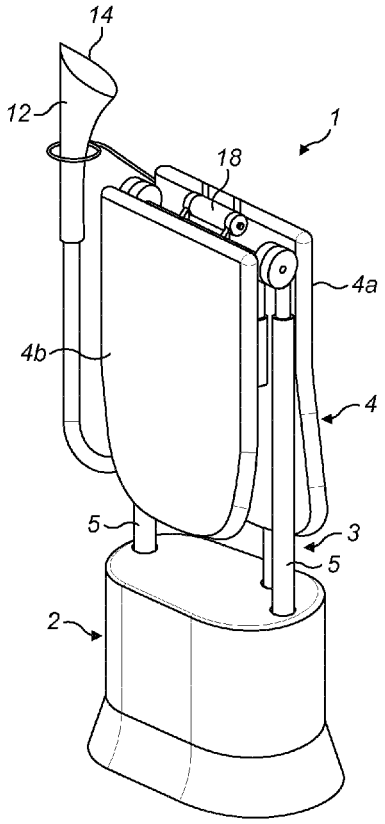
FIG. 2 shows a perspective view of the device of FIG. 1 in a storage position.

The support structure 3 including telescopic support posts 5 preferably enables the height of the ironing board 4 to be adjusted to suit a user. Also, the telescopic support posts 5 preferably enable the garment treatment device 1 to collapse down to a more compact storage position P4, for example as shown in FIG. 2, to reduce the space occupied when not in use.

The ironing board 4 is divided into the first and second ironing board sections 4*a*, 4*b* proximate the mid-point of the ironing board 4, that is, at a dividing line 20 extending across the ironing board 4 substantially perpendicular to the longitudinal direction of the ironing board 4. This arrangement advantageously allows the optimum compact configuration of the garment treatment device 1 when in the storage position P4.

Furthermore, the first and second ironing board sections 4*a*, 4*b* and the hinge mechanism 18 are configured such that the first and second ironing board sections 4*a*, 4*b* pivot away from each other from a co-planar orientation when in an operative position, by substantially 180 degrees into the storage position P4, in which they are substantially parallel to each other. This arrangement further advantageously allows the optimum compact configuration of the garment treatment device 1 when in the storage position P4.

Figure 9:
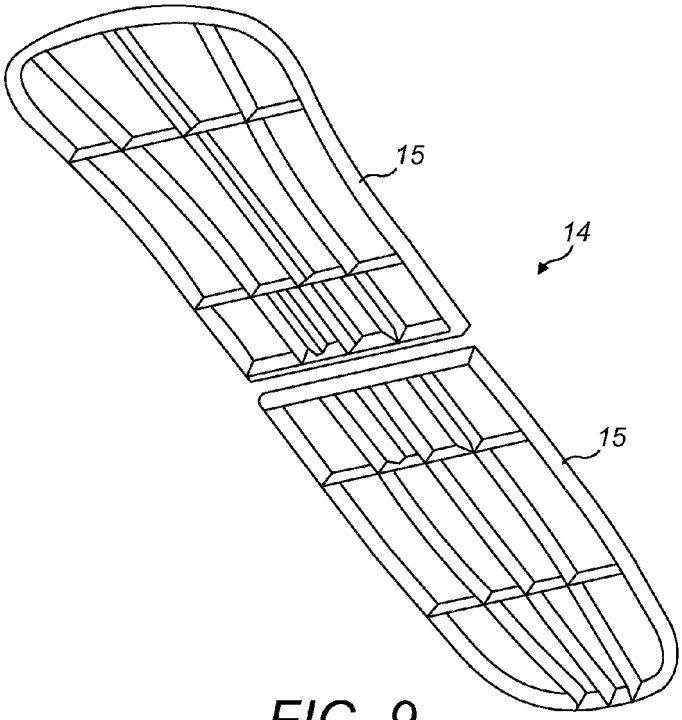
FIG. 9 shows a perspective view of a frame of the device of FIG. 1.
Figure 10:
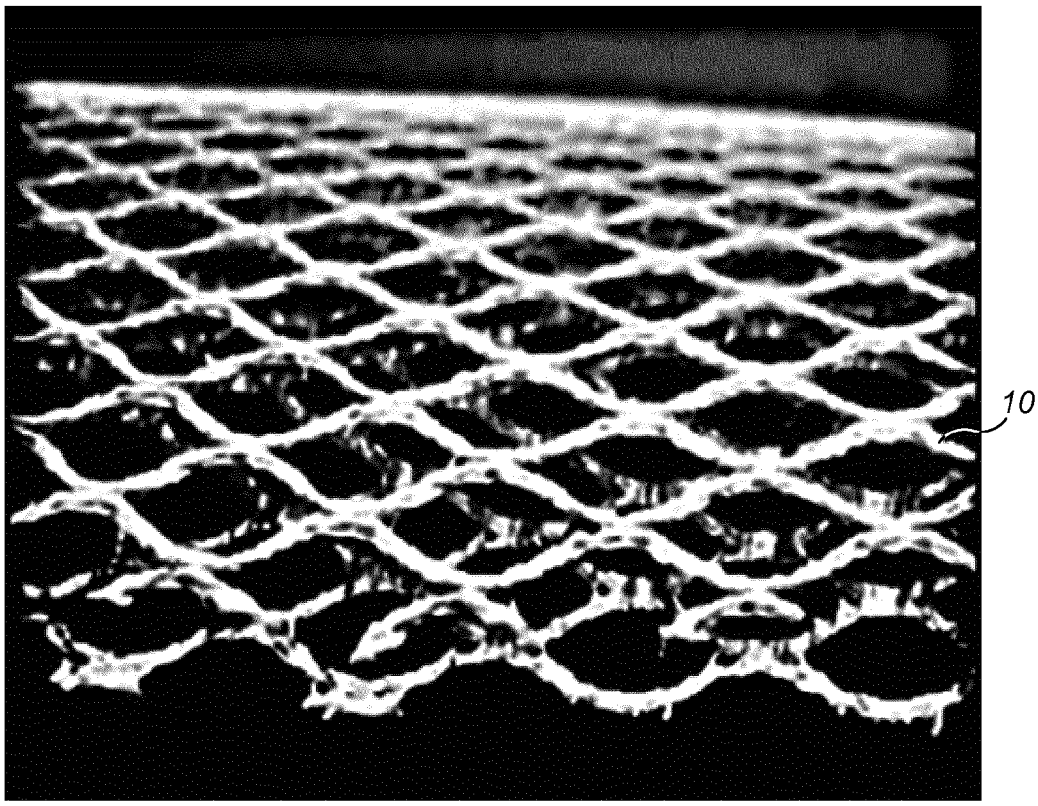
FIG. 10 shows an enlarged view of a portion of a cover material of the device of FIG. 1.

The ironing board 4 is advantageously made of a rigid material such as plastic or metal. This may provide a firm surface for a user to press against during garment treatment, in which ever operative position the ironing board 4 is oriented. This advantageously enables more effective treatment of tricky or thicker fabric areas such as collars and cuffs, or thicker fabric generally. In particular, in the second (vertical) operative position P2, the user can treat garments by pressing against the rigid ironing board 4 surface, without the need to manually tension the garment. This advantageously avoids the risk of a user scorching their hand with steam during use. The ironing board 4 may be a solid component or may be made as a framework 15 of structural elements, as shown in FIG. 9. In either case, the ironing board is preferably covered with a cover material 10. The cover material 10 is preferably tensioned over the ironing board 4 and may be tensioned over the entire ironing board 4, or may comprise two separate cover material sections, one tensioned over each of the first and second ironing board sections 4*a*, 4*b* respectively. A section of such a cover material 10 is shown in FIG. 10 and comprises a fabric with three dimensional ("3D") structure—that is the cover material 10 is formed as a lattice or matrix structure providing thickness and depth to the material structure and to provide an air space within the thickness of the cover material 10. This advantageously allows improved dispersion of steam that permeates through a garment being treated during use of the garment treatment device 1. This may also ensure fuller utilisation of steam supplied during the garment treatment process, as the steam can pass through the garment, through the 3D spacing fabric and deflect back to the garment.

The ironing board 4 comprises a first side 8 and a second, opposite side 9, for example an upper side 8 and a lower side 9. The cover material 10 may preferably be provided such that it extends over at least a portion of both sides 8, 9 of the ironing board 4, and preferably entirely over both sides 8, 9 of the ironing board 4. This advantageously enables a user to treat garments using both sides of the ironing board 4, for example when the ironing board 4 is arranged in the second (vertical) operative position P2.

An end 6 of the ironing board 4 that is uppermost when the ironing board 4 is in the second (vertical) operative position P2 may preferably comprise a region 7 of increased width relative to the remainder of the ironing board 4. This may advantageously provide a greater ironing surface when in the first (horizontal) operative position P1, and may also serve as a garment hanger when in the second (vertical) operative position P2. For example, the wider region 7 can serve to fit within shoulder areas of a hanging garment to be treated.

The end 6 of the ironing board 4 preferably also includes a garment hanging hook 21 to allow a garment to be hung from a conventional coat hanger and to lie against the ironing board 4 for treatment. The hanging hook 21 is preferably adjustable relative to the ironing board 4, for example the hanging hook 21 may be provided on a telescopic pole (not shown) attached to the first ironing board section 4*a*. An adjustable height hanging hook 21 may advantageously allow different lengths of garments to be treated whilst hanging vertically, for example shirts and long dresses.

The garment treatment device 1 is advantageously a garment steamer device, and includes a steam generator 11 disposed within the base 2. The steam generator 11 may comprise a heating chamber (not shown) and a water reservoir (not shown) to supply water to the heating chamber to generate steam. The steam generator 11 is preferably connected to a hand-held steamer head 12 via a steam hose 13. A user is thereby able to treat garments by application of steam from the hand-held steamer head 12. The hand-held steamer head 12 may include a heated sole plate 14 forming a contact surface which is pressed against garments being treated. The steam may be expelled through vents (not shown) in the sole plate 14. The hand-held steamer head 12 preferably is able to function for vertical garment treatment, inclined garment treatment and horizontal garment treatment like a conventional steam iron. The heated sole plate 14 may also advantageously improve steaming function by evaporating any condensed steam in use, as well as improving garment de-wrinkling function. Again, this may advantageously improve garment treatment performance, particularly tricky garment areas or areas of thicker fabric.

Figure 3:
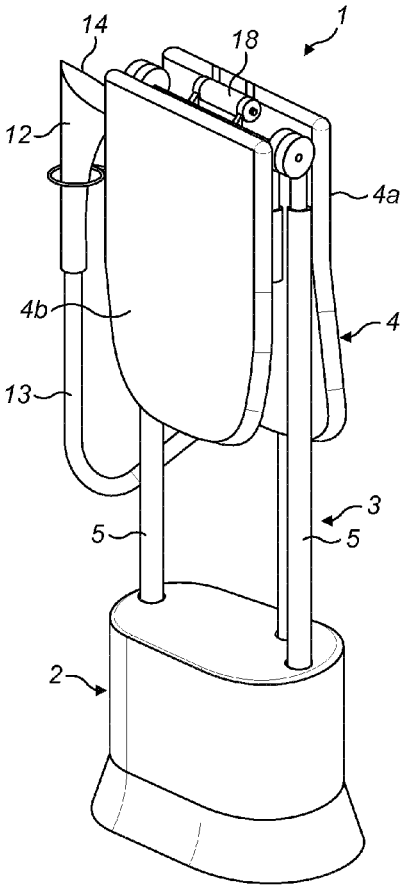
FIG. 3 shows a perspective view of the device of FIG. 1 in a first partially erected position.
Figure 4:
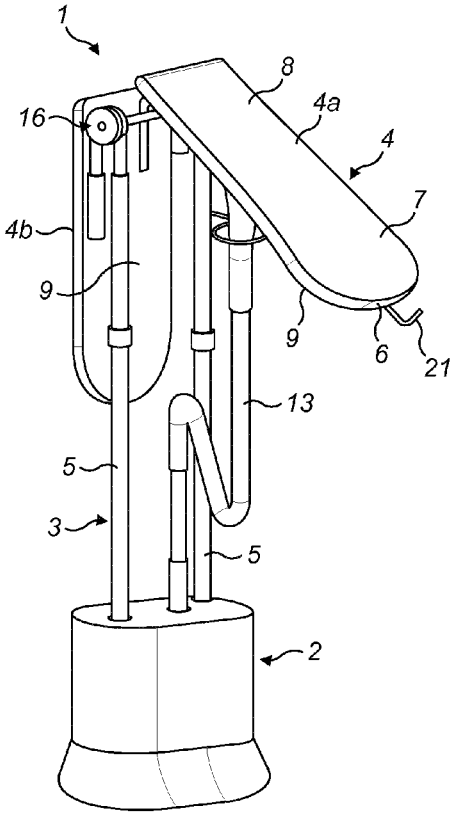
FIG. 4 shows a perspective view of the device of FIG. 1 in a second partially erected position.
Figure 5:
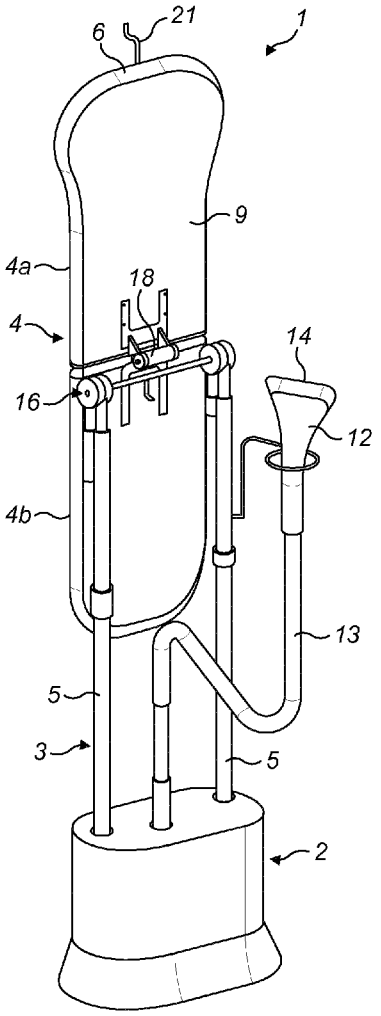
FIG. 5 shows a perspective view of the device of FIG. 1 in a vertical operative position.
Figure 6:
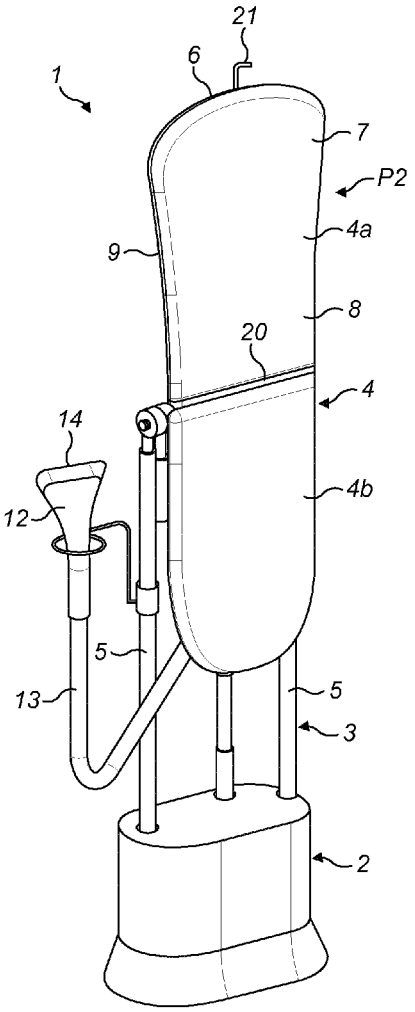
FIG. 6 shows an alternative perspective view of the device of FIG. 1 in the vertical operative position.

To convert the garment treatment device 1 from the storage position P4 shown in FIG. 2, to the first (horizontal) operative position P1 shown in FIG. 1, a user first extends the folded ironing board 4 upwards away from the base 2 by extending the telescopic support poles 5, as shown in FIG. 3. The first ironing board section 4*a* is then pivoted upwards about the hinge mechanism 18, as shown in FIG. 4, until it extends vertically and co-planar with the second ironing board section 4*b*, as shown in FIG. 5. The fixing means locks the first and second ironing board sections 4*a*, 4*b* in the co-planar position relative to each other. The garment treatment device 1 is then in the second (vertical) operative position P2. The user then depresses the button 19 to release the locking mechanism to allow the ironing board 4 to be pivoted into the first (horizontal) operative position P1, as shown in FIG. 1. The button 19 is then released and the ironing board 4 remains locked in the first operative position P1. The garment treatment device 1 is returned to the storage position P4 by the reverse of the process described above.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A garment treatment device comprising a base, a support structure extending upwardly from the base, and an ironing board connected to the support structure, the ironing board being pivotable relative to the support structure and positionable into a first operative position (P1) in which the ironing board is horizontal, and a second operative position (P2) in which the ironing board is vertical, wherein the ironing board comprises a first section and a second section hingedly coupled together by a hinge mechanism and pivotable relative to each other between an operative position in which they extend co-planar to each other and a storage position in which they are pivoted away from a co-planar orientation, wherein the first and second ironing board sections and the hinge mechanism are configured such that the first and second ironing board sections pivot away from each other from said operative position towards said storage position.

2. A garment treatment device according to claim 1, wherein the ironing board is positionable into a third operative position which extends at an inclined angle between the first operative position (P1) and the second operative position (P2).

3. A garment treatment device according to claim 2, wherein the ironing board is positionable into a plurality of intermediate operative positions between the first operative position (P1) and the second operative position (P2).

4. A garment treatment device according to claim 1, wherein the first and second ironing board sections are pivotable relative to each other through substantially 180 degrees between the operative and storage positions.

5. A garment treatment device according to claim 1, wherein the first and second ironing board sections are spaced from each other and substantially parallel to each other when in the storage position.

6. A garment treatment device according to claim 1, wherein the first and second ironing board sections are disposed on either side of the support structure to each other when in the storage position.

7. A garment treatment device according to claim 1, wherein the ironing board and second section proximate a mid-point along the length of the ironing board.

8. A garment treatment device according to claim 1, wherein the support structure comprises a telescopic mechanism to vary the distance between the ironing board and the base.

9. A garment treatment device according to claim 8, wherein the telescopic mechanism comprises a pair of parallel spaced telescopic support posts extending from the base and to which the ironing board is pivotably connected.

10. A garment treatment device according to claim 1, wherein an end of the ironing board that is uppermost in the vertical operative position comprises a region of ironing surface of increased width relative to the rest of the ironing board.

11. A garment treatment device according to claim 1, wherein the ironing board comprises a first opposite side, a second opposite side, and a three dimensional structure spacing fabric extending over at least a portion of both the first and a second sides of the ironing board.

12. A garment treatment device according to claim 1, further comprising a steam generator disposed in the base, a hand-held steamer head, and a steam hose fluidly connecting a steam outlet of the steam generator with the hand-held steamer head.

13. A garment treatment device according to claim 12, wherein the hand-held steamer head includes a heated sole plate.

14. A garment treatment device according to claim 1, wherein the ironing board comprises a skeleton frame.

* * * * *